United States Patent [19]

Shimamura

[11] 4,248,011

[45] Feb. 3, 1981

[54] SELF-OPERATIVE STEERING FOR RADIO-CONTROLLED MODEL CAR

[75] Inventor: Juki Shimamura, Soka, Japan

[73] Assignee: Asahi Communications, Incorporated, Soka, Japan

[21] Appl. No.: 38,549

[22] Filed: May 14, 1979

[30] Foreign Application Priority Data

Sep. 26, 1978 [JP] Japan ..... 53-132214[U]

[51] Int. Cl.[3] ..... A63H 29/22

[52] U.S. Cl. ..... 46/254

[58] Field of Search ..... 46/253, 254, 255, 256, 46/257, 258, 259, 260, 261, 244 R

[56] References Cited

U.S. PATENT DOCUMENTS

| | | | |
|---|---|---|---|
| 3,752,246 | 8/1973 | Sullivan | 46/254 |
| 3,813,812 | 6/1974 | Barlow et al. | 46/259 |
| 3,909,276 | 9/1975 | Wolf | 46/253 |
| 4,165,581 | 8/1979 | Wolf | 46/256 |
| 4,171,592 | 10/1979 | Saitoh | 46/254 |

FOREIGN PATENT DOCUMENTS

| | | | |
|---|---|---|---|
| 786977 | 11/1957 | United Kingdom | 46/256 |

*Primary Examiner*—Robert A. Hafer

*Attorney, Agent, or Firm*—Wills, Green & Mueth

[57] ABSTRACT

A self-operative steering for radio-controlled model car per se operative corresponding to radio-controlling signals transmitted from a controller of the model car. The steering comprises a housing containing a servomechanism therein, a pair of wheel-shaft receiving means with steering means protruded from the both sides of the housing and a tie rod connecting the steering means with the servomechanism in co-operative position. The servomechanism is operative corresponding to the controlling signals to operate the steering means.

12 Claims, 9 Drawing Figures

SELF-OPERATIVE STEERING FOR RADIO-CONTROLLED MODEL CAR

BACKGROUND OF THE INVENTION

The present invention relates to a steering employed for a radio-controlled model or miniature car for steering of driving thereof. More specifically, the invention relates to a self-operative steering containing therein a servomechanism so as to be self-operative corresponding to radio-controlling signals transmitted from controller.

The radio-controlled model car has employed a plurality of various controlling means for controlling the driving speed, changing front and back-ward movement, and steering in order to perform variable actions. The respective controlling means are co-operated with servomechanisms respectively provided for the model car corresponding to the controlling means. To control or operate one of the controlling means, it is required one servomechanism. There are further employed in the model car a decorder for discrimination of the various controlling signals and for input the signals to the servomechanism which may operate desired controlling means for performing sought operations, and a power supply generally being electric batteries. On the chassis of the model car, there are arranged the aforementioned elements constituting mechanisms of the model car.

In the prior arts, there are so many elements on the chassis, particularly on the portion within wheel base thereof, that may not easily plan the arrangement of respective elements. Especially, on planning the arrangement of the steering and servomechanism therefor, has been arisen troublesome problems to be solved. One of the problems is that, since the dimension between the steering and servomechanism is per se defined in relationship of each other for exact co-operation, the arrangement thereof should be planned in relationship of each other relative to other elements. The other problem is that the steering and servomechanism often limit the size or width of the chassis where they are mounted in relation one another, thus they interfere employment of them in small-sized model cars.

While, it is desirable to exchange various car bodies mounted on single chassis with controlling means. As the various car bodies often have different wheel bases, it may frequently necessary to adapt the locations of the wheels on the chassis corresponding thereto. But, in the conventional construction of the model car, it is practically difficult to adapt the location of the wheels to various wheel bases of the car bodies, since there are so many elements on the chassis that may not allow freely locating the wheels with the steering and servomechanism. Thereby, on the single chassis, it can be mounted generally one car body of which the wheel base is adapted to dimension of the front and back wheels on the chassis. This has been required to change car body to obtain or buy the chassis with elements adapting the wheel base to the car body.

Further, since the conventional steerings are supplied as independent members separated to servomechanisms, there are required so many parts consisting therefor as to result in high-cost of manufacturing or production. And moreover, they have required expense for work on assembling respective steering and servomechanism separately. Thereby, the model kits are so expensive as not to easily buy.

The invention is to improve disadvantages of the prior arts by way of combining the steering and servomechanism as single element capable of self-operation corresponding to radio-controlling signals.

SUMMARY OF THE INVENTION

Therefore, it is the object of the invention to provide a self-operative steering for radio-controlled model car which can be per se operative corresponding to radio-controlling signals. More specified object of the invention is to provide a steering have a servomechanism therein.

Another object of the invention is to provide a radio-controlled model car employing the self-operative steering to allow exchange of car bodies on the single chassis.

To achieve the above-mentioned and other objects, the self-operative steering according to the invention comprises:

- a housing having a pair of wheel-shaft receiving means with steering means to rotate the former means, on both sides thereof;
- a servomechanism contained within the housing and including an electric motor driven corresponding to controlling signals; and
- a tie rod connecting the servomechanism with steering means so as to steer the model car by operation of former.

Preferably, the housing may be movably secured on the chassis of the model car in order to adapt the location of the wheels with the steering to the wheel bases of the car bodies for exchanging various car bodies on the chassis.

The steering according to the invention can be per se operative to steer the model car corresponding to controlling signals. The above constructed steering can allow adapting the location of the wheels on the chassis to the wheel bases of the car bodies. Thus, it is no longer necessary to expend for the chassis in order to exchange car bodies. And, the steering in accordance with the invention can reduce the cost for manufacturing or producing by coupling the steering and servomechanism as single element so as to decrease the numbers of parts and expense for work on assembling.

Other objects and advantages of the invention will be described hereinafter.

BRIEF DESCRIPTION OF THE DRAWINGS

The present invention will be illustrated more fully by way of examples with reference to accompanying drawings, in which.

DESCRIPTION OF THE PREFERRED EMBODIMENT

Figure 1:
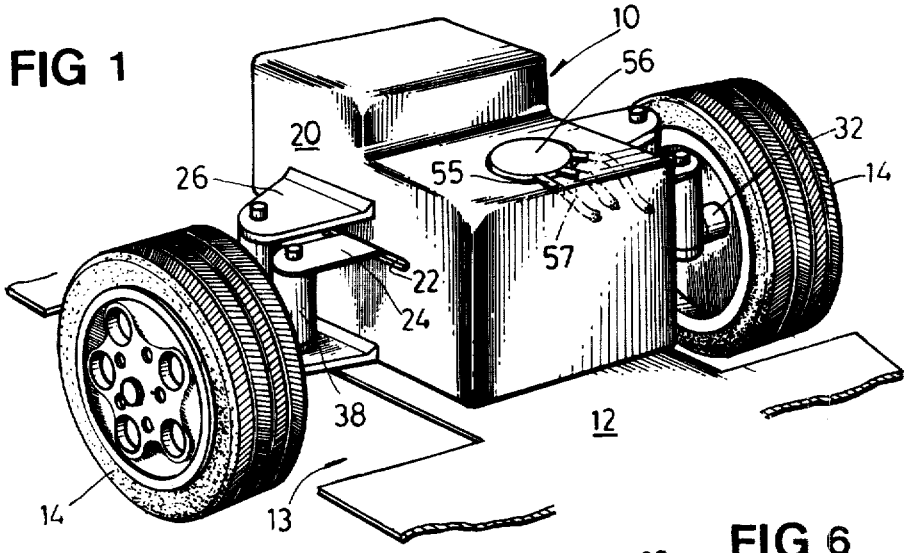
FIG. 1 is a perspective view of a steering mounted on a chassis of a model car, according to the first embodiment of the invention.

Referring now to the drawings, particularly to FIG. 1, there is illustrated a steering 10 according to the first embodiment of the invention with wheels 14, equipped or mounted on a chassis 12 of a model car. The steering 10 will be arranged on the chassis as to position the wheels 14 within dents or cut-outs 13 formed on both sides of the chassis. As may be apparent, the portion illustrated herewith is a front-side portion of the model car, since the steering is generally provided for steer model car by controlling the front wheels thereof.

Figure 5:
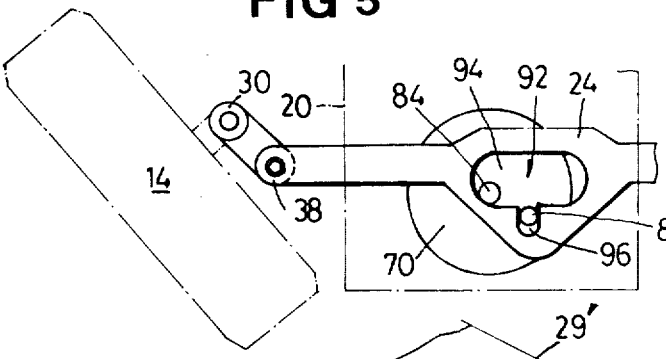
FIG. 5 is a schematic plan view generally showing a tie rod in an operative position.
Figure 8:
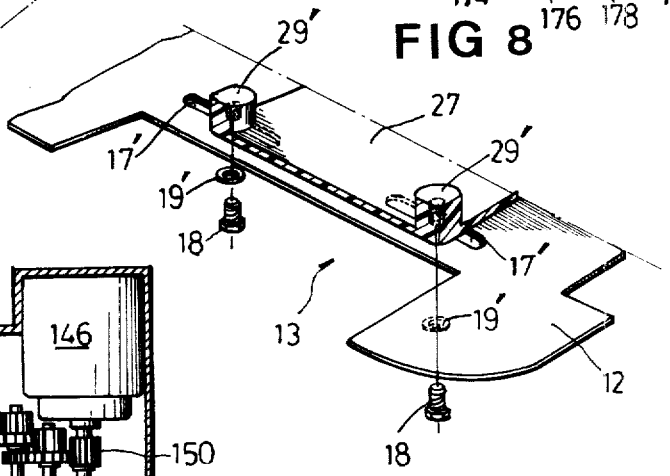
FIG. 8 is an enlarged partial perspective view on the portion of the base of the housing, showing manner for securing the housing onto the chassis.

The steering has a housing 20 being made of plastic materials. However, the housing can be made of either plastic materials or metallic materials, it is advantageous to make it of plastic materials for easy processing and low cost of the raw materials. The housing 20 is secured on the chassis 12 by bolts or screws 18 received through apertures 16,29 respectively formed on the chassis 12 and a base 27 of the housing 20. The apertures 16 are provided on the chassis in aligned position so as to capable of selectively adapting the aperture 29 thereto for match the wheel base with that of car bodies, as shown in FIG. 5. The bolts 18 engage with nuts 19 through washer 19'. The nuts 19 are fixed on the inner surface of the base 27. It will be expected that there are various way to secure the housing on the chassis in movable position. In FIG. 8, there is illustrated another embodiment for securing the housing on the chassis, for an example. The housing 20 is provided with projective portions on four corners of the base 27 thereof. Each projective portion 29' is formed downwardly opened dent with thread formed on the inner periphery thereof. The chassis 12 is formed two pairs of elongated slits 17' aligned one another to receive bolts 18 and movably secure the housing on the chassis. The bolts 18 engage to the thread of the dents through the slits 17' and washer 19' so as to allow the housing adapting the location to the wheel base of the car bodies.

The housing 20 is formed lateral slits 22 on side walls 25 through which both ends of a tie rod 24 are extended sidewardly from the housing 20. The housing 20 is also provided, on the side walls 25, two pairs of triangular plates 26 extended sidewardly from the upper and lower portions thereof. Each pair of upper and lower triangular plates 26 are provided with a pair of apertures 28 aligned one another. Between each pair of triangular plates 26, there are equipped with a shaft 30 with axes 34 protruded upper and lower ends thereof to engage with the apertures 28. Thereby, the shaft 30 is rotatable about the axes 34. On the vertical intermediate portion of the shaft 30, there is provided with a wheel-shaft receiving means to rotatably receive the wheel-shaft 32. A lateral plate 36 is extended from the lower portion of the shaft 30 directed backwardly therefrom. The free end of the plate 36 are provided with a shaft 38 protruded upwardly which has an axis 40 on the top thereof.

The axis 40 engages with an aperture 44 formed on each end of the tie rod 24. The tie rod 24 is received in the housing horizontally movable by operation of a servomechanism 50 contained within the housing 20. Thus, the tie rod 24 pulls and/or pushes the shaft 38 in order to rotate the shaft 30 for steering the model car.

Figure 2:
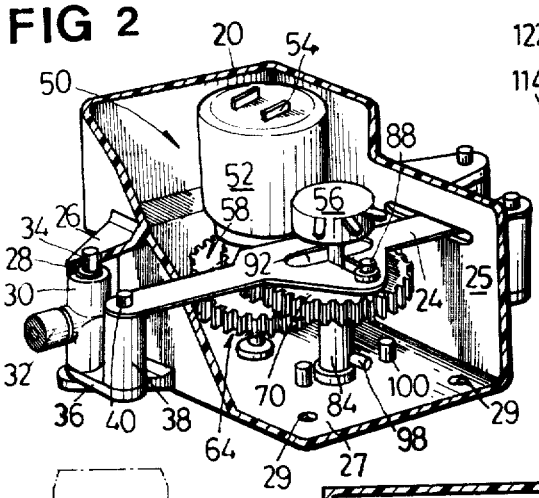
FIG. 2 is a partially sectioned perspective view of the steering of FIG. 1.
Figure 3:
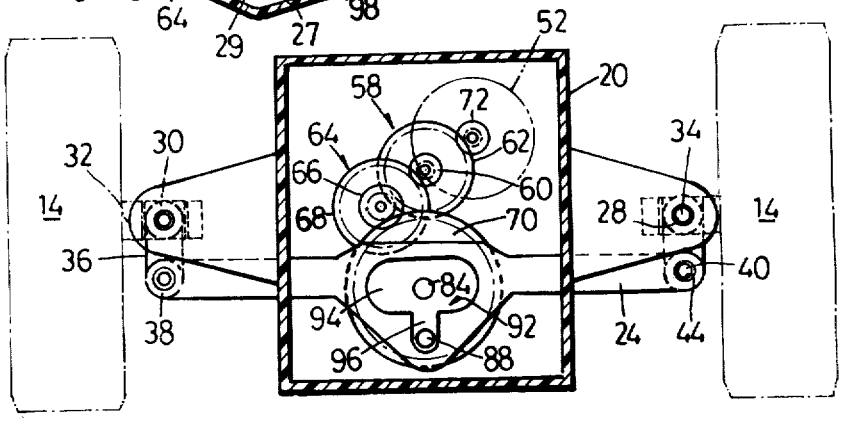
FIG. 3 is a plan view of the steering of FIG. 1, but the ceiling of the housing being omitted.
Figure 4:
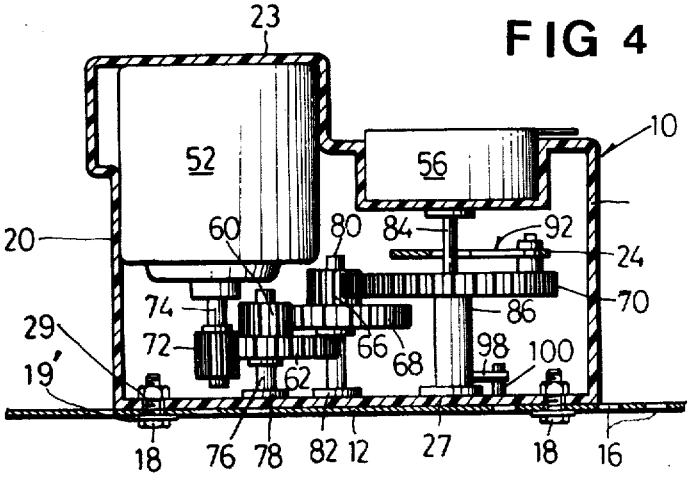
FIG. 4 is an enlarged sectional view of the steering of FIG. 1, taken along longitudinal center line of the housing.

As shown in FIGS. 2 through 4, the servomechanism 50 contained within the housing 20 comprises an electric motor 52 connected with a volume 56, and a plurality of reduction gears. The motor 52 is preferred a variable motor capable of driving in various speed and/or in different direction. The volume controls the driving speeds and/or directions of the motor 52 corresponding to controlling signals for steering the model car in desired speed or direction. The volume 56 is mounted on the ceiling 23 of the housing. Terminals 55 are protruded from the volume 56 with which the volume 56 is connected with a decorder (not shown) by leads 57.

The reduction gears of the servomechanism can be embodied in various numbers, types and combinations of the gears in accordance with desired reducing ratios. However, in this embodiment, there are employed first and second reduction gears 58, 64 each of which integrally has stepped two gear portions 60,62 and 66,68. The gear portions 60, 66 consist small gears of the reduction gears and the other portions 62,68 consist larger gears thereof. The small gear 66 of the second reduction gear 64 is engaged with an operative gear 70. The large gear 62 of the first reduction gear 58 engages with a pinion 72 fixed on the top of a motor shaft 74. The small gear 60 and the large gear 68 of the reduction gears 58,64 are interengageable each other. Respective reduction gears 58,64 are fixed on axes 76,80 respectively equipped on the base 27 of the housing 20 through bosses 78,82. The operative gear 70 is fixed to an axis 84 which has a portion 86 where the diameter thereof is larger than that of remaining portion, under the operative gear 70. A lateral projection 98 is protruded from the portion 86 to contact with a pair of aparted projections 100 provided on the base 27 of the housing. Thus, the projections 98 and 100 function as stopper to limit rotation of the operative gears 70. In the preferred embodiment, the projections 100 are respectively positioned to have approximate seventy-five degrees of gaps from diametrical line of the axis 84 along the longitudinal center line of the housing 20. Thereby, the operative gear 70 fixed on the axis 84 is limited the rotation within a range respective approximate seventy-five degrees in clockwise and counterclockwise from the neutral position.

A projection 88 is protruded upwardly from the adjacent circumference of the operative gear 70. The tie rod 24 is provided with a generally T-shape opening 92 comprising a lateral wide portion 94 through which the axis 84 extends upwardly, and a vertical narrow portion 96, on the central portion thereof. The width and length of the lateral portion 94 is defined so as not to be interfered the movement of the tie rod 24 by the axis 84. The projection 88 is engaged with the vertical or longitudinal portion of the opening and movably secured thereto by an equipment 90. The projection 88 moves the tie rod 24 in the rotation of the operative gear 70 to move the shafts 38 sectorially about the axes 34 for horizontally rotate the wheels for steering.

In preferred construction, the distance between the projection 88 and the axis 84 is matched with that of between rods 30 and 38 to adequately affect the movement of the projection 88 to the rod 30 for exact steering.

In operation, the radio-controlling signals is transmitted from the controller apart from the model car. The controlling signals are received through an antenna of the model car and input to the decorder.

The radio-controlling signals are discriminated on the decorder and fed into the servomechanism operating sought controlling means. The controlling signals for steering are input to the volume 56 of the servomechanism 50 through the decorder. Then, the electric motor 52 starts driving corresponding to desired controlling or operation speeds or direction. The control of operation speed and/or direction of the motor 52 is performed by the volume 56 which supplys various electric charge so as to control operation speed of the former.

Rotation or torque of the motor shaft 74 is transmitted to the operative gear 70 through the reduction gears 58, 64. On the transmitting the rotation, the reduction gears 58,64 reduce the torque into desired ratios. Thereafter, the projection is sectorially moved about the axis 84 of the operative gear 70. As apparently shown in FIG. 5, the projection 88 moves the tie rod 24 in lateral directions. Corresponding to sectorial movement of the projection 88, it moves longitudinal direction along the narrow portion 96 of the opening 92 of the tie rod 24. When the tie rod 24 moves lateral directions, the portion 94 of the opening 92 functions to allow the movement thereof without being interfered or effected the movement by the axis 84.

By the lateral movement of the tie rod 24, the shafts 38 are pulled and/or pushed lateral direction to sectorially move about the axes 34. According to the sectorial movement of the shafts 38, the tie rod 24 is moved longitudinal direction. The slit 22 formed on the housing 20 allow the longitudinal movement of the tie rod 24 therealong. Thus, the shafts 30 are rotated with the wheel-shaft receiving means so as to horizontally rotate the wheels 14 for steering.

In preferred construction, dimension between the projection 88 and the axis 84 is matched with that of between axes 34,40 to match loci of sectorial movement thereof. In matching the loci, the projection 88 can exactly rotate the shafts 30 for adequate steering.

The operative gear 70 is limited the rotation directed clockwise and counterclockwise within the range respective approximate seventy-five degrees from neutral position by contacting the projection 98 to the projections 100. Thereby, the projection 88 moves in the range approximate seventy-five degrees in the direction clockwise and counterclockwise from the neutral position about the axis 84.

Figure 6:
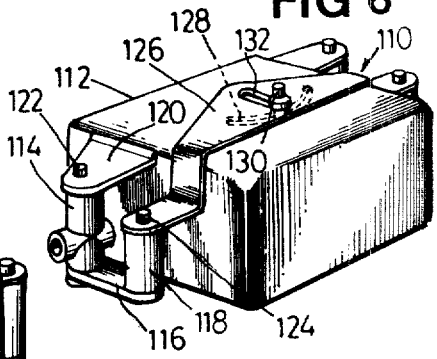
FIG. 6 is a perspective view of a steering according to the second embodiment of the invention.

In FIG. 6, there are illustrated a steering 110 in accordance with the second embodiment of the invention. The steering 110 comprises a housing 112 having pairs of triangular plates 120 on both sides thereof, shafts 114 with wheel-shaft receiving means rotatably equipped between the upper and lower triangular plates 120, shafts 118 connected with the shafts 114 by plates 116 and a tie rod 126 mounted over the housing 112. An axis 124 is protruded from the top of each shaft 118 and engaged with an aperture formed on the end of the tie rod 126. The tie rod 126 is provided on the central portion thereof an elongated longitudinally extended slit 132. To the slit 132, a projection 130 mounted on an operative gear of the servomechanism which is contained within the housing 112, is engaged to operate the tie rod 126 in lateral direction. The servomechanism of this embodiment is generally similar to the aforementioned first embodiment of the invention.

The housing 112 is formed a slit 128 of an arc of a circle shape to be running through the projection 130. The radius of the circle of the slit 130 is matched with the dimension between the projection 132 and an axis of the operation gear. Both ends of the slit 130 may act as stoppers for limiting sectorial movement of the projection 130. Each end of the slit 128 may not exceed the range of ninety degrees from longitudinal center line of the housing. Preferably, the ends of the slit 128 are positioned approximate seventy-five degrees in clockwise and counterclockwise from the center line of the housing 112. Thus, in operation of the servomechanism, the projection 130 is moved clockwise and counterclockwise from the neutral portion within the range respective approximate seventy-five degrees where it contacts to the ends of the slit 128.

In operation of the steering 110, corresponding to the controlling signals, the servomechanism contained in the housing 112, is operative as mentioned on the first embodiment. Thus, the projection 130 moves sectorially to move the tie rod 126 laterally. By lateral movement of the tie rod 126, the shafts 118 are moved sectorially about the shafts 114. Thereby, the shafts 114 are rotated to horizontally rotate the wheels for steering.

Figure 7:
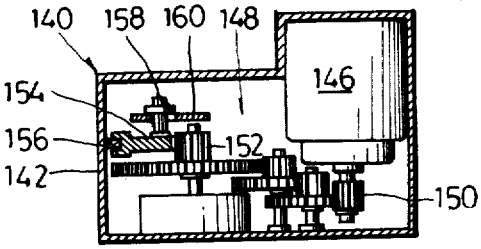
FIG. 7 is a sectional view of a steering according to the third embodiment of the invention, taken along the longitudinal center line of the housing.

In FIG. 7, there is illustrated a steering 140 in accordance with the third embodiment of the invention. The steering 140 has a housing made of metallic materials, in various metaric materials, it may be preferred aluminiums in light weight thereof. A servomechanism 148 is contained within the housing 140 with a tie rod 160. The servomechanism 148 comprises a plurality of reduction gears, an electric motor, preferably being a variable motor, 146, a volume controlling the motor 146 in driving speeds and directions thereof, and a rack 154 engaging the final reduction gear and movable in lateral directions. A guide rail 156 is protruded from the side walls of the housing 140, and engaged with the rack 154 for guiding the latter on lateral movement thereof. In preferred embodiment, the final gear of the reduction gear 148 integrally has a pinion 152 engaging to the rack 154 for moving the latter in lateral position. On the upper surface of the rack 154, there is provided a projection 158 engaging to the tie rod 160 in order to cooperate the tie rod 160 with the servomechanism 148.

The tie rod 160 extends both ends thereof from the housing 140. The respective ends of the tie rod 160 are connected with axes provided on the top of shafts which are connected with wheel-shaft receiving means by plates and act as steering means. Thereby, corresponding to operation of the servomechanism 148, the tie rod 160 pulls and/or pushes the steering means for rotate wheels horizontally to steer.

However, this embodiment employs the tie rod 160 connected with the rack 154 by the projection 158, it may be expected that the rack having both ends where extend from the housing and engage with the steering means for acting as tie rod, in order to operate the steering means without tie rod.

Preferably, the tie rod 160 is movable about the projection 158 corresponding to sectorial movement of the steering means. In preferred construction, there are provided a longitudinal slit on the central portion of the tie rod in alignment of the center line of the housing to receive the projection in laterally movable position.

In operation, the radio-controlling signals are input to the volume of the servomechanism through decorder. Corresponding to controlling signals, the electric motor 146 starts driving to operate the servomechanism 148. The torque or driving of the motor 146 is reduced by the reduction gears and fed to the pinion 152 of the final reduction gear. The pinion 152 is rotated to move the rack 154 in lateral directions with the tie rod 160. Thereby, the tie rod 160 pulls and/or pushes the steering means to horizontally rotate the wheels for steering.

Figure 9:
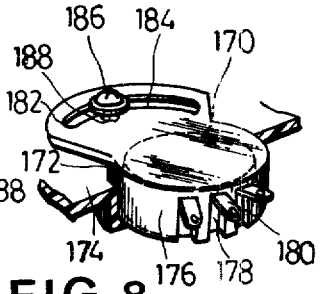
FIG. 9 is an enlarged perspective view of a volume in accordance with another embodiment of the invention.

In FIG. 9, there is illustrated a modified embodiment of a volume 170 connected with a motor (not shown) of a servomechanism, for controlling the motor in driving speeds and/or directions. The volume 170 is received into a groove 172 formed on a ceiling 174 of the housing. A cover member 176 having slits 178 on the periphery thereof, is fitted over the volume 170, of which terminal 180 exporded outwards through the slits 178.

The cover member 176 is provided a laterally extended fan-shaped element 182 having a slit 184 of an arc of a circle shape. Through the slit 184, a screw 186 is engaged with a thread formed on the inner periphery of an opening 188 on the ceiling 174, in order to fix the cover member 176 onto the groove 172 of the ceiling 174.

Thereby, to seek and/or decide a neutral position of the volume, the cover member 176 is rotated about the groove 172 together with the volume 170 by engagement of slits 178 and terminal s 180. And, thereafter, the cover member 176 with the volume 170 is secured onto the groove 172 by the screw 186 in exact position on neutral.

Thus, it is apparent that there has been provided a novel and useful steering for radio-controlled model car which fulfills all of the objects and advantages sought therefor.

While, specific embodiments of the invention has been shown and described in detail to illustrate the application of the principles of the invention, it will be apparent that the invention may be embodied otherwise without departing from such principles.

I claim:

1. A self-operative steering arrangement for a radio-controlled model car having first and second wheel-shaft receiving members with first and second steering means, respectively, on opposite sides of the car operative corresponding to radio-controlling signals by operation of a servomechanism, wherein the improvement comprises in combination:

a housing mountable to the chassis of said model car, said housing having said wheel-shaft receiving members and steering means mounted in co-operative position on both sides thereof;

drive means contained within said housing and capable of changing driving speeds and directions corresponding to control signals;

a reduction gear train driven by said drive means;

operative means engageable with said reduction gear train;

a tie rod connecting said first steering means with said second steering means; and a connecting element attached to said operative means and engaging said tie rod such that said steering mechanism is actuable by said drive means to steer the model car.

2. A steering arrangement as defined in claim 1, wherein said drive means is an electric variable motor capable of changing driving speeds and/or directions corresponding to control signals.

3. A steering arrangement as defined in claim 2, wherein said servomechanism includes a volume means driven by said operative means for the electrical control of said drive means, which volume means is rotatably mounted on the ceiling of the housing to easily seek a neutral position thereof.

4. A steering arrangement as defined in claim 2, wherein said motor is connected with a volume means driven by said operative means for electrically controlling the speed and direction of the motor to correspond to desired speed and direction of operation of the servomechanism.

5. A steering arrangement as defined in claim 1, 2, 3 or 4, wherein said operative means comprises a gear and said connecting element includes a projection extending from a point adjacent to the circumference of said operative gear and engaged with the tie rod through a slit formed on the central portion of the tie rod.

6. A steering arrangement as defined in claim 1, 2, 3 or 4, wherein said operative means comprises a rack engageable with and moveable laterally relative to one of said reduction gears and said connecting element includes a projection extending from the upper surface of said rack and engaging the tie rod through a slit formed in the central portion of the tie rod and extended laterally thereon.

7. A steering arrangement as defined in claim 5, wherein said servomechanism includes means for limiting the movement of the operative means with the tie rod connected thereto.

8. A steering arrangement as defined in claim 7, wherein said means for limiting movement of the operative means are provided to limit said movement within a range in which the steering means move sectorially about the wheel-shaft receiving means within respective angles of approximately seventy-five degrees from a neutral position thereof.

9. A radio-controlled model car having a speed controlling means, a running direction controlling means and steering means therein, each of which is operative corresponding to radio-controlling signals, wherein the improvement comprises in combination;

the steering means comprising a servomechanism operative corresponding to the controlling signals and movably secured on a chassis of the model car in a manner allowing the location thereof to be changed, altering the wheel base of the chassis.

10. A model car as defined in claim 9, wherein said steering mechanism comprises a housing having wheel-shaft receiving means and steering means in co-operative position on both sides thereof; and a servomechanism contained within said housing and operatively connected with said steering means by a tie rod.

11. A model car as defined in claim 9 or 10, wherein said servomechanism contained within the housing is driven by an electric motor capable of changing driving speeds and directions corresponding to the desired operation speeds and directions of the servomechanism.

12. A model car as defined in claim 11, wherein said motor is connected with a volume means driven by said operative means to electrically control the driving speeds and directions thereof.

* * * * *